US007138921B1

(12) United States Patent
Fontaine

(10) Patent No.: US 7,138,921 B1
(45) Date of Patent: Nov. 21, 2006

(54) COMPUTERIZED SWIMMING POOL SECURITY SYSTEM AND METHOD

(76) Inventor: John V. Fontaine, c/o The Discipleship Broadcasting Corp., 2699 N. State Rd. 7, Ft. Lauderdale, FL (US) 33313

( * ) Notice: Subject to any disclaimer, the term of this patent is extended or adjusted under 35 U.S.C. 154(b) by 120 days.

(21) Appl. No.: 10/901,712

(22) Filed: Jul. 30, 2004

(51) Int. Cl.
*G08B 23/00* (2006.01)

(52) U.S. Cl. ..... 340/573.4; 340/573.1; 340/506; 348/156

(58) Field of Classification Search ..... 340/573.4, 340/573.1, 539.15, 506; 348/156, 152, 143
See application file for complete search history.

(56) References Cited

U.S. PATENT DOCUMENTS 4,747,085 A 5/1988 Dunegan et al.
5,023,593 A 6/1991 Brox
5,253,070 A * 10/1993 Hong ..... 348/155
5,504,520 A * 4/1996 Yamamoto ..... 348/154
5,631,630 A 5/1997 McSweeney
5,903,218 A 5/1999 Nelson
6,003,164 A 12/1999 Leaders
6,157,304 A 12/2000 Bennett et al.
6,445,409 B1 * 9/2002 Ito et al. ..... 348/155
6,583,724 B1 6/2003 Rodriguez
6,690,411 B1 2/2004 Naidoo et al.
6,720,880 B1 * 4/2004 Gutta et al. ..... 340/573.4
6,950,022 B1 * 9/2005 Breed ..... 340/552

* cited by examiner

*Primary Examiner*—Anh V. La
(74) *Attorney, Agent, or Firm*—Oltman, Flynn & Kubler

(57) ABSTRACT

A child security system activates an alarm when an unsupervised child enters a monitored area, including a security camera for receiving video images from a monitored area; a computer; a security camera being linked to send video data from the monitored area to the computer; and system software loaded in the computer enabling the computer to distinguish the image of a child entering the monitored area, distinguishing the image of a child from an image of an adult or an animal, determining whether the image of an adult is simultaneously present within the monitored area, and an alarm linked to the computer so that the computer sends an ON signal to the alarm causing the alarm to activate when the image of a child is detected and no image of an adult is simultaneously detected, indicating that an unsupervised child has entered the monitored area.

4 Claims, 5 Drawing Sheets

Schematic of Security System

Schematic of Security System

Secured Area - a protected area in which the alarm can be turned on if the moving objects meet the object size criteria.

Object Size Criteria - the criteria of the actual object size that would turn on the alarm.

A/P Value - the ratio of actual size of an object and the picture size of an object on the screen (pixel count).

Subprograms - 2

Evaluate Objects' Size

Update Comparison Picture

Detect Moving Objects

Get Current Picture

COMPUTERIZED SWIMMING POOL SECURITY SYSTEM AND METHOD

BACKGROUND OF THE INVENTION

1. Field of the Invention

The present invention relates generally to the field of hazard detection and security systems. More specifically the present invention relates to a computerized security system for detecting when an unsupervised child enters a potentially dangerous area such as the vicinity of a swimming pool or a road and upon detection for sounding an alarm to bring an adult into the area to prevent injury to the child. The system includes a security camera for receiving video images from a monitored area, and a computer loaded with system software, the security camera being linked to send video data from the monitored area to the computer and the system software enabling the computer to distinguish the image of a child entering the monitored area, distinguishing the image of a child from an image of an adult or an animal, determining whether the image of an adult is simultaneously present within the monitored area, and an alarm linked to the computer so that the computer sends an ON signal to the alarm causing the alarm to sound when the image of a child is detected and no image of an adult is simultaneously detected, indicating that an unsupervised child has entered the monitored area. When an adult responds to the alarm and enters the monitored area the system software causes the computer to automatically send an OFF signal to the alarm causing the alarm to stop sounding. Thus the system does not have to be deactivated to shut off the alarm. The alarm does not sound if an image of an adult is detected in the monitored area, regardless of whether an image of a child is detected at the same time.

The method includes the steps of the security camera receiving video images from a monitored area, the computer distinguishing an image of a child entering the monitored area, differentiating an image of a child from an image of an adult or an animal, determining whether an image of an adult is simultaneously present within the monitored area, and if an image of a child is detected and an image of an adult is not detected, sending an ON signal to the alarm causing the alarm to sound, indicating that an unsupervised child has entered the monitored area. When the computer detects an image of an adult in the monitored area, sending an OFF signal to the alarm causing the alarm to stop sounding.

2. Description of the Prior Art

There have previously been alarm devices for sounding an alarm when a child enters a swimming pool, and these often are activated by waves in the pool water or by a broken ultrasonic or light beam. A problem with these prior systems has been that an adult or animal entering the pool would also activate the alarm, and false alarm diminish the effectiveness of the security system. Another problem is that injury or death may occur within a short time after alarm activation, leaving a narrow window for response. Yet another problem is that the device must be shut off after alarm activation, and those present may neglect to turn the device back on, so that children subsequently entering the pool remain undetected. Finally, many prior pool alarms are not designed for or capable of monitoring other areas which are dangerous to children.

Examples of prior alarm systems include the method and apparatus for monitoring swimming pools disclosed in Dunegan, et al., U.S. Pat. No. 4,747,085, issued on May 24, 1988. Dunegan, et al., includes a transmitter mounted below the surface of the pool water to transmit ultrasonic sound waves, and alteration of the transmitted signal caused by disturbance of the pool water actuates an alarm.

Naidoo, et al., U.S. Pat. No. 6,690,411, issued on Feb. 10, 2004, teaches a security system including a computer and a video camera for transmitting video data to a base station. A network is provided through which a control station communicates with the base station and a remote station communicates with the base station and the control station.

Brox, U.S. Pat. No. 5,023,593, issued on Jun. 11, 1991, teaches a passive infrared/acoustic pool security system. Brox includes a passive infrared system and an underwater acoustic element, the infrared element generating a thin infrared layer overlaying the entire water surface area of the pool. The infrared element detects any heat generating body passing through the infrared layer.

McSweeney, U.S. Pat. No. 5,631,630, issued on May 20, 1997, reveals a low voltage pool security system for preventing infants from entering a swimming pool area. McSweeney monitors exit doors of a home leading to the pool and monitors the swimming pool itself with motion detectors.

Nelson, U.S. Pat. No. 5,903,218, issued on May 11, 1999, discloses a pool alarm detecting wave motion. Nelson includes a transducer responsive to positive and negative pressure changes in swimming pool water.

Leaders, U.S. Pat. No. 6,003,164, issued on Dec. 21, 1999, teaches a pool monitor and controller. Leaders controls fluid level and provides other maintenance functions.

Bennett, et al., U.S. Pat. No. 6,157,304, issued on Dec. 5, 2000, reveals a pool alarm system. Bennett, et al. includes a drain blockage sensor and infrared motion detectors which sense motion near a pool surface and sound an alarm.

Rodriguez, U.S. Pat. No. 6,583,724, issued on Jun. 24, 2003, discloses a pool alarm system for alerting when an object such as a child enters a swimming pool. The system includes a sensor for detecting movement of the pool water surface.

It is thus an object of the present invention to provide a child security system and method which detects the presence of a child as soon as they enter a monitored area such as the area of a swimming pool or a road and sounds an alarm, so that adults are alerted before an injury can occur.

It is another object of the present invention to provide such a child security system and method which distinguishes between a child and an adult and between a child and an animal and which activates the alarm only upon detection of a child and simultaneous absence of an adult in the monitored area.

It is still another object of the present invention to provide such a child security system and method which automatically deactivates the alarm upon entry of an adult into the monitored area, so that the system never has be shut off and consequently there is no risk of neglecting to turn the system back on.

It is finally an object of the present invention to provide such a child security system and method which is equally suited to monitoring many different types of areas dangerous to children, and which is reliable, easy to install and maintain and relatively inexpensive.

SUMMARY OF THE INVENTION

The present invention accomplishes the above-stated objectives, as well as others, as may be determined by a fair reading and interpretation of the entire specification.

A child security system is provided for sounding an alarm when an unsupervised child enters a monitored area, including a security camera for receiving video images from a monitored area; a computer; a security camera being linked to send video data from the monitored area to the computer; and system software loaded in the computer enabling the computer to distinguish the image of a child entering the monitored area, distinguishing the image of a child from an image of an adult or an animal, determining whether the image of an adult is simultaneously present within the monitored area, and an alarm linked to the computer so that the computer sends an ON signal to the alarm causing the alarm to sound when the image of a child is detected and no image of an adult is simultaneously detected, indicating that an unsupervised child has entered the monitored area.

A child security system is further provided for sounding an alarm when a child enters a monitored area, including a security camera for receiving video images from a monitored area; a computer; a security camera being linked to send video data from the monitored area to the computer; and system software loaded in the computer enabling the computer to distinguish the image of a child entering the monitored area, distinguishing the image of a child from an image of an adult or an animal, and an alarm linked to the computer so that the computer sends an ON signal to the alarm causing the alarm to sound when the image of a child is detected, indicating that a child has entered the monitored area.

A computer executed method is provided for detecting entry of an unsupervised child into a monitored area using a system including a security camera for receiving video images from a monitored area, a computer, and a security camera being linked to send video data from the monitored area to the computer, and system software, comprising the steps of the security camera receiving video images from a monitored area; the computer distinguishing the image of a child entering the monitored area from other images in the monitored area; differentiating the image of a child from any image of an adult or of an animal within the monitored area; determining whether an image of an adult is simultaneously present within the monitored area; and if an image of a child is detected and an image of an adult is not detected, sending an ON signal to the alarm causing the alarm to sound, indicating that an unsupervised child has entered the monitored area. The system preferably includes the additional steps of detecting an image of an adult in the monitored area; and sending an OFF signal to the alarm causing the alarm to stop sounding.

A computer executed method for detecting entry of an unsupervised child into a monitored area using a system including a security camera for receiving video images from a monitored area, a computer, and a security camera being linked to send video data from the monitored area to the computer, and system software, comprising the steps of the security camera receiving video images from a monitored area; the computer distinguishing the image of a child entering the monitored area from other images in the monitored area; differentiating the image of a child from any image of an adult or of an animal within the monitored area; and if an image of a child is detected, sending an ON signal to the alarm causing the alarm to sound, indicating that a child has entered the monitored area.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
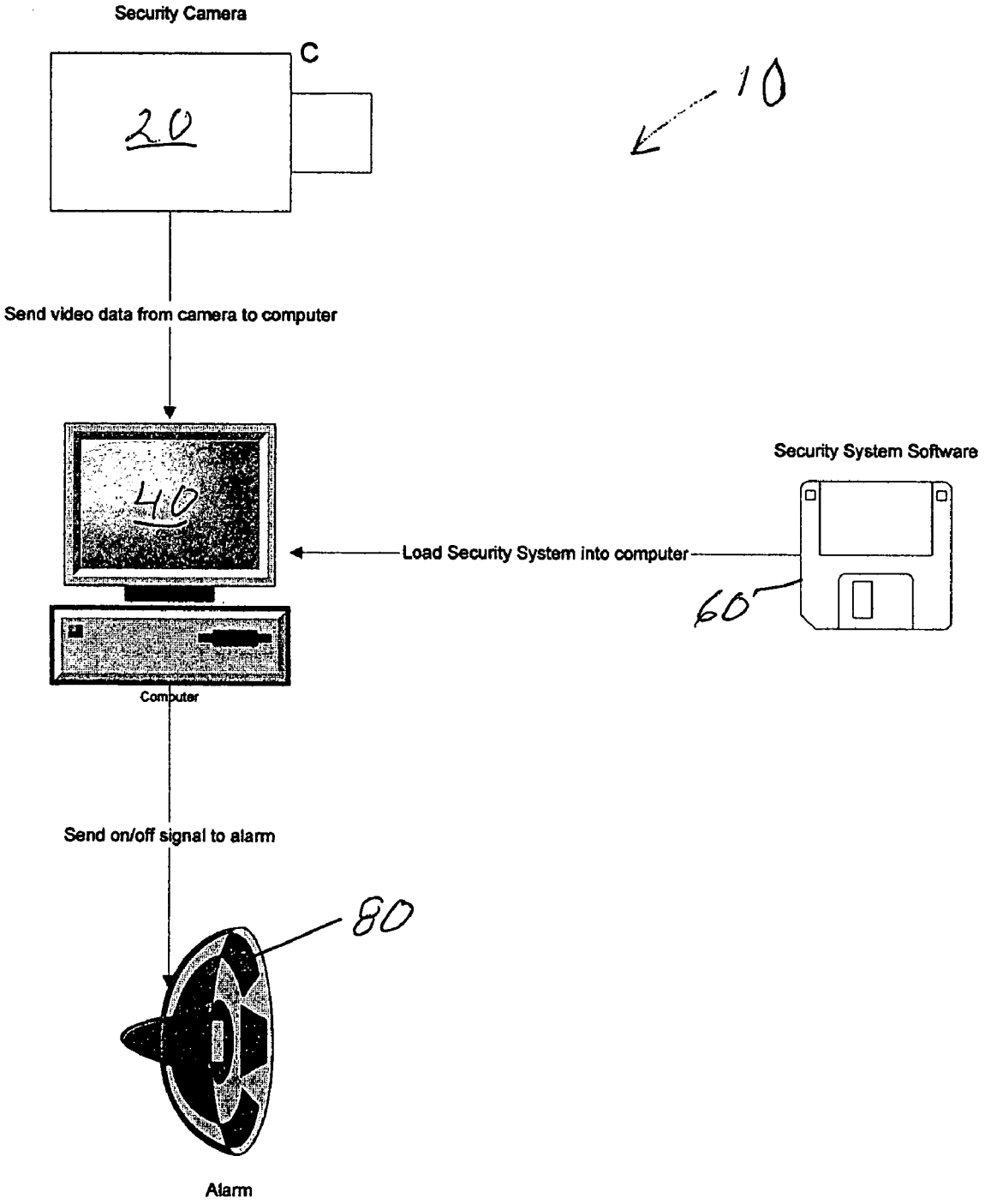
FIG. 1 is a schematic of the essential elements of the present security system.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–6, a computerized security system 10 is disclosed for monitoring an area dangerous to children and for sounding an alarm upon detection of a child entering the monitored area. System 10 includes a security camera 20 for receiving video images from a monitored area, and a computer 40 loaded with system software 60, the security camera 20 being linked to send video data from the monitored area to the computer 40 and system software 60 enabling the computer 40 to distinguish the image of a child entering the monitored area, distinguishing the image of a child from an image of an adult or an animal, determining whether the image of an adult is simultaneously present within the monitored area, and an alarm 80 linked to the computer 40 so that the computer 40 sends an ON signal to the alarm 80 causing the alarm 80 to sound when the image of a child is detected and no image of an adult is simultaneously detected, indicating that an unsupervised child has entered the monitored area. When an adult responds to the alarm 80 and enters the monitored area the system software 60 causes the computer 40 to automatically send an OFF signal to the alarm 80 causing the alarm 80 to stop sounding. Thus the system 10 does not have to be deactivated to shut off the alarm 80. The alarm 80 does not sound if an image of an adult is detected in the monitored area, regardless of whether an image of a child is detected at the same time.

System 10 detects the presence of a moving object within the monitored area and then identifies the moving object as a child by determining whether the object falls within a certain size range. System 10 is primarily intended to detect small children. The alarm 80 is turned on if the moving object meets the object size criteria of the system program. The actual object size that would turn on the alarm 80 is calculated by determining the ratio of an object and the picture size of the object on the screen, preferably by the number of pixels forming the object image. The alarm 80 may be any conventional alarm which, for example, generates sound or radiates light or both.

Figure 2:
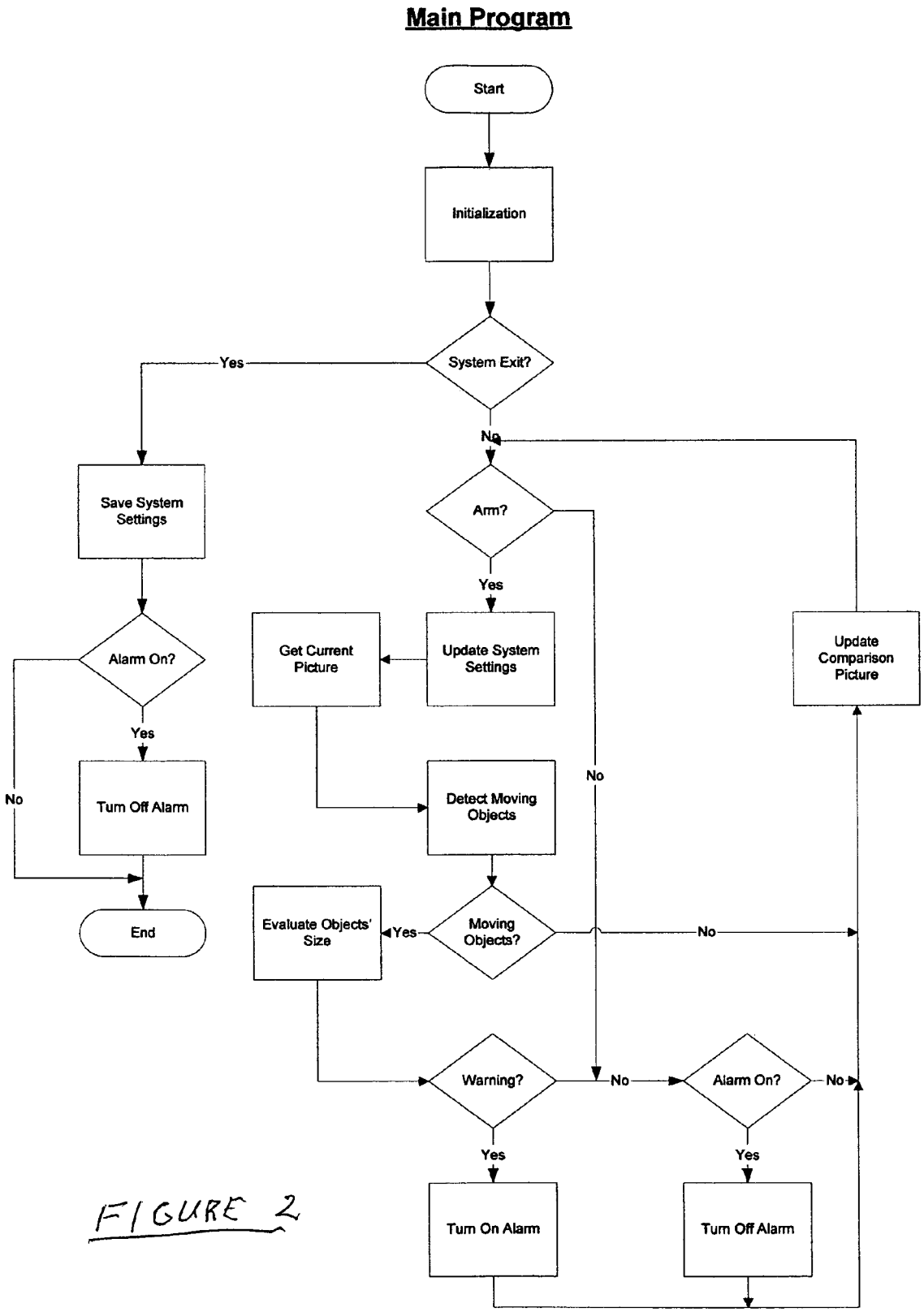
FIG. 2 is a flow chart of the main system software program.
Figure 3:
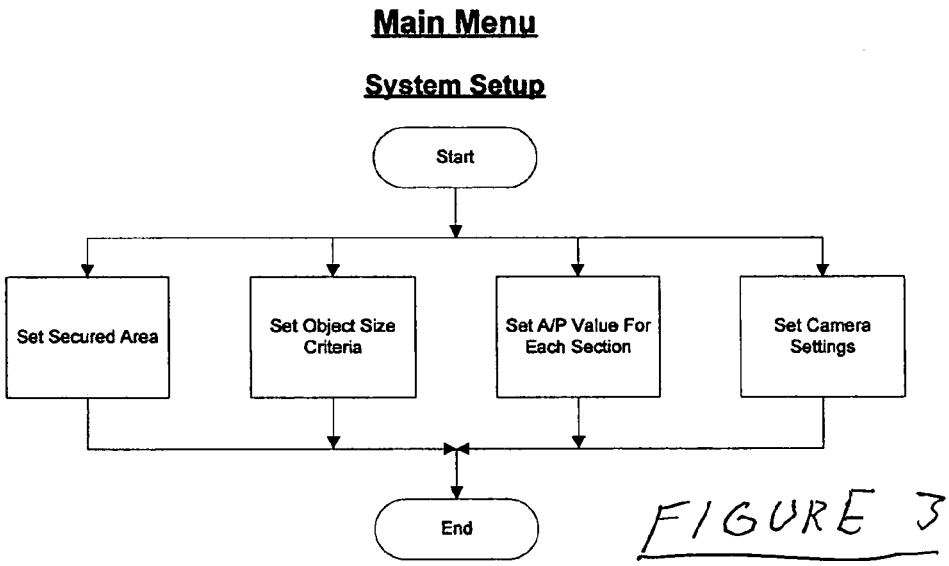
FIG. 3 is a flow chart of the main menu.
Figure 4:
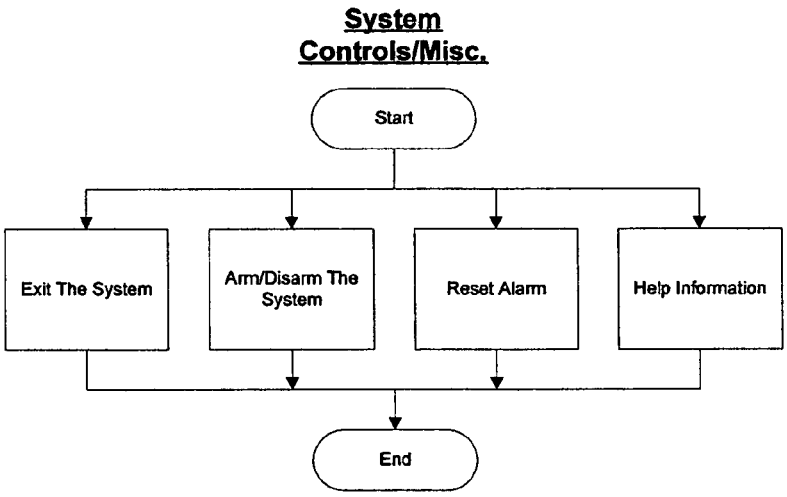
FIG. 4 is a flow chart of the system controls and miscellaneous functions.
Figure 5:
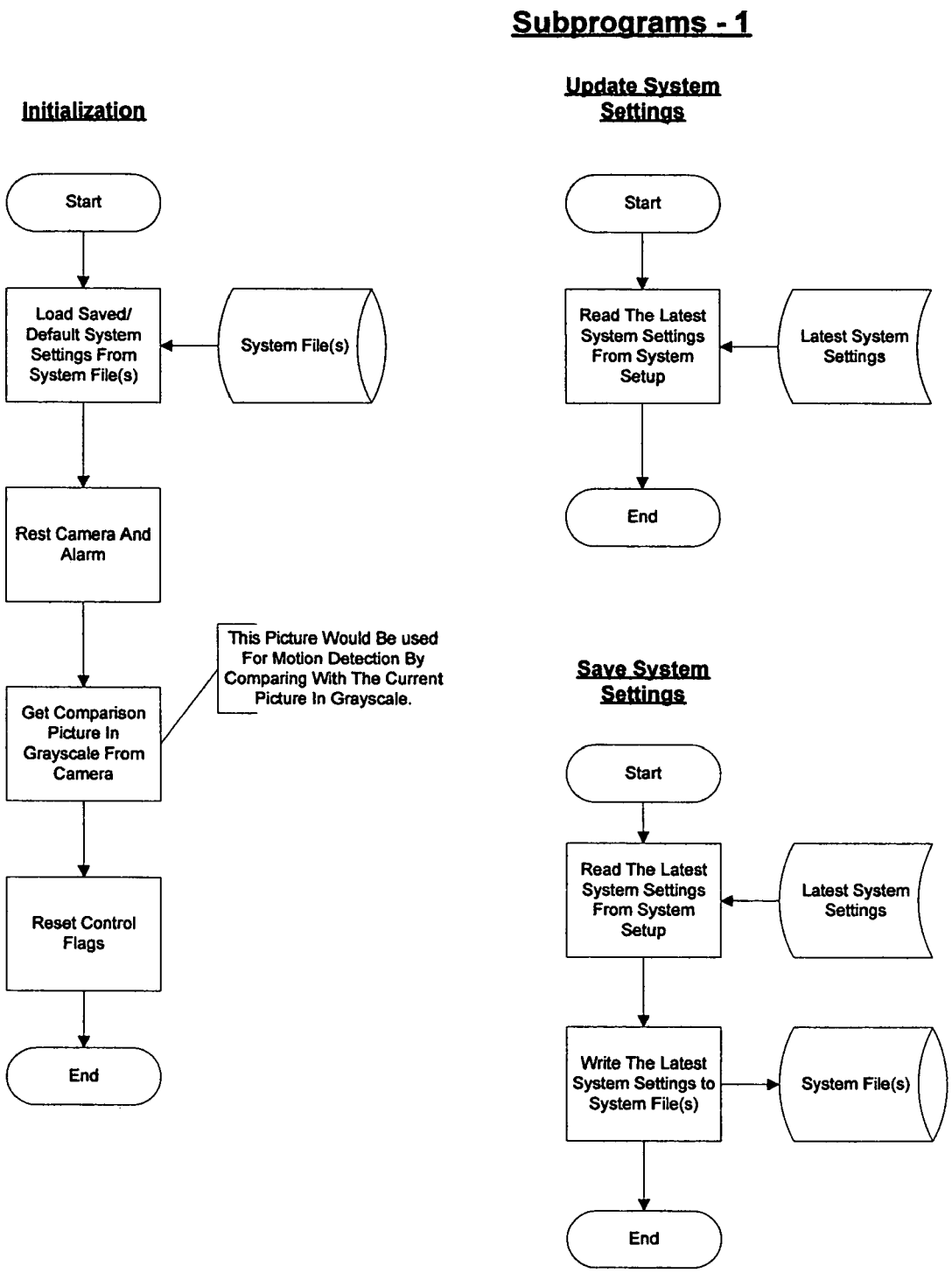
FIG. 5 is a flow chart of subprogram-1 for updating and settings system settings.
Figure 6:
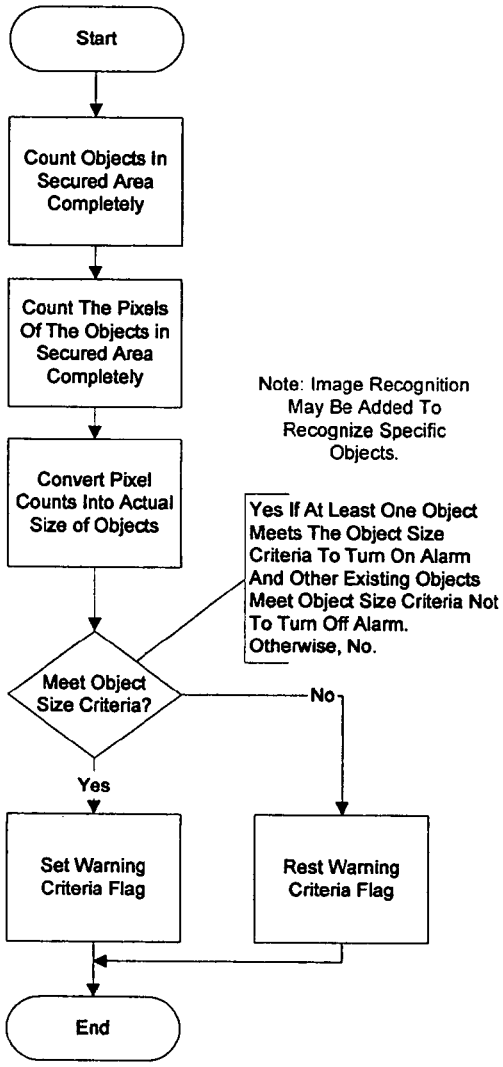
FIG. 6 is a flow chart of subprogram-2 for detecting and evaluating moving objects and receiving and comparing current pictures.
Figure 6:
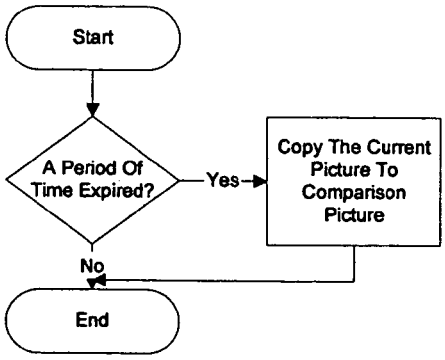
Figure 6:
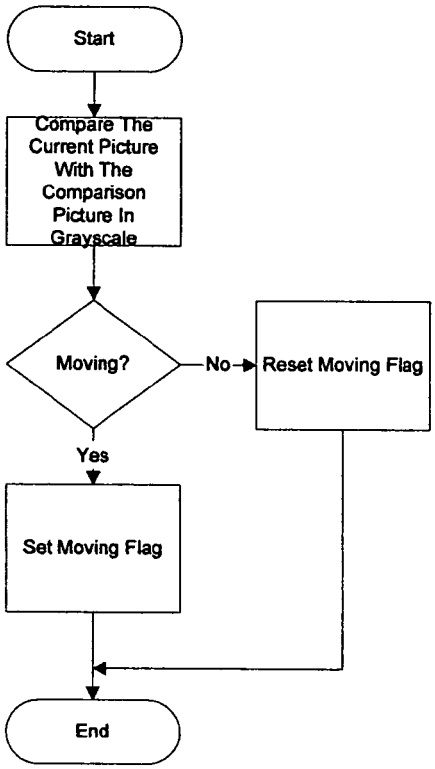
Figure 6:
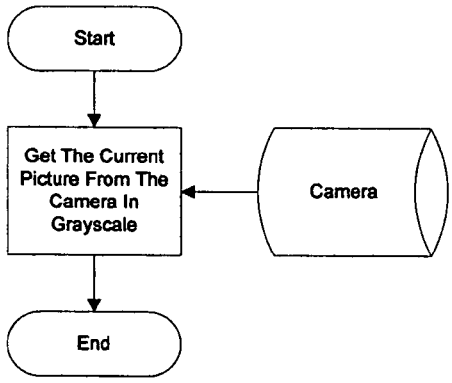

The main system software 60 program follows the flow chart set forth in FIG. 2. The Main Menu flow chart is shown in FIG. 3, the System Controls/Miscellaneous flow chart is shown in FIG. 4, and FIG. 5 shows the Subprogram-1 flow chart for updating and settings system settings, and FIG. 6 shows the Subprogram-2 flow chart for detecting and evaluating moving objects and getting and comparing current pictures.

Method

In practicing the invention, the following method may be used. The method includes the steps of security camera 20 receiving video images from a monitored area, the computer 40 distinguishing an image of a child entering the monitored area, differentiating an image of a child from an image of an adult or an animal, determining whether an image of an adult is simultaneously present within the monitored area, and if an image of a child is detected and an image of an adult is not detected, sending an ON signal to the alarm 80 causing the alarm 80 to sound, indicating that an unsupervised child has entered the monitored area. When the computer 40 detects an image of an adult in the monitored area, sending an OFF signal to the alarm 80 causing the alarm 80 to stop sounding.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A child security system for activating an alarm when an unsupervised child enters a monitored area, comprising:

a security camera for receiving video images from a monitored area;

a computer;

and the security camera being linked to send video data from the monitored area to the computer;

and system software loaded in said computer enabling the computer to distinguish the image of a child entering the monitored area, distinguishing the image of a child from an image of an adult or an animal, determining whether the image of an adult is present within the monitored area simultaneously with a child, and the alarm linked to the computer such that the computer sends an ON signal to the alarm causing the alarm to activate when the image of a child is detected and no image of an adult is simultaneously detected, indicating that an unsupervised child has entered the monitored area.

2. A computer executed method for detecting entry of an unsupervised child into a monitored area using a system including a security camera for receiving video images from a monitored area, a computer, and the security camera being linked to send video data from the monitored area to the computer, and system software, comprising the steps of:

the security camera receiving video images from the monitored area;

the computer distinguishing the image of a child entering the monitored area from other images in the monitored area;

differentiating the image of a child from any image of an adult or of an animal within the monitored area;

determining whether an image of an adult is present within the monitored area simultaneously with a child;

and if an image of a child is detected and an image of an adult is not detected, sending an ON signal to the alarm causing the alarm to activate, indicating that an unsupervised child has entered the monitored area.

3. The system of claim 2, comprising the additional steps of:

detecting an image of an adult in the monitored area;

and sending an OFF signal to the alarm causing the alarm to deactivate.

4. A computer executed method for detecting entry of an unsupervised child into a monitored area using a system including a security camera for receiving video images from the monitored area, a computer, and the security camera being linked to send video data from the monitored area to the computer, and system software, comprising the steps of:

the security camera receiving video images from a monitored area;

the computer distinguishing the image of a child entering the monitored area from other images in the monitored area;

differentiating the image of a child from any image of any of an adult and an animal within the monitored area;

determining whether the image of an adult is present within the monitored area simultaneously with a child;

and if an image of a child is detected and no image of an adult is simultaneously detected, sending an ON signal to the alarm causing the alarm to activate, indicating that a child has entered the monitored area.

* * * * *